US008695980B1

(12) United States Patent
Gonter

(10) Patent No.: US 8,695,980 B1
(45) Date of Patent: Apr. 15, 2014

(54) WEAVE PUZZLE

(76) Inventor: Louis J. Gonter, Placerville, CA (US)

( * ) Notice: Subject to any disclaimer, the term of this patent is extended or adjusted under 35 U.S.C. 154(b) by 0 days.

(21) Appl. No.: 13/403,203

(22) Filed: Feb. 23, 2012

(51) Int. Cl.
*A63F 9/08* (2006.01)

(52) U.S. Cl.
USPC ..... 273/157 R; 273/155

(58) Field of Classification Search
USPC ..... 273/157 R, 155
See application file for complete search history.

(56) References Cited

U.S. PATENT DOCUMENTS

| | | | | | |
|---|---|---|---|---|---|
| 1,696,987 | A | * | 1/1929 | Troidl | 273/155 |
| 1,903,226 | A | * | 3/1933 | Perry | 273/155 |
| 2,333,731 | A | * | 11/1943 | Monroe et al. | 273/155 |
| 2,345,709 | A | * | 4/1944 | Lobdell | 273/155 |
| 2,439,583 | A | * | 4/1948 | Shamah | 273/155 |
| 3,235,262 | A | * | 2/1966 | Frankl | 273/155 |
| 3,656,248 | A | * | 4/1972 | Echter | 434/426 |
| 3,913,910 | A | * | 10/1975 | Sahl | 273/157 R |
| D345,996 | S | * | 4/1994 | Bates | D21/480 |
| D351,872 | S | * | 10/1994 | Bates | D21/478 |
| 5,368,301 | A | * | 11/1994 | Mitchell | 273/157 R |
| 7,125,255 | B2 | * | 10/2006 | Queen | 273/153 R |

OTHER PUBLICATIONS

Ecosolution International Trading Limited; Weave Puzzle; http://ecosolution.co.nz/products.html.

* cited by examiner

*Primary Examiner* — Steven Wong
(74) *Attorney, Agent, or Firm* — Heisler & Associates

(57) ABSTRACT

A plurality of first strips and second strips are provided, each including portions of an overall composite image thereon. The strips are woven together to cause the portions of the image to be joined together to complete the composite image. Blanks can be provided on portions of the strips which weave under portions of other strips. The strips are initially provided on multiple sheets which are printed with an image which has gaps built thereinto by removing portions of the image so that when the sheets are cut into strips and the weave is completed, a distortion free composite image results. A software application can be provided which converts the image into the sheets, ready for printing on a personal printer and cutting. The invention can be implemented upon a computer through manipulation of strip objects appearing on a display associated with the computer to virtually weave the strip objects together.

25 Claims, 9 Drawing Sheets

WEAVE PUZZLE

FIELD OF THE INVENTION

The following invention relates to puzzles which take an image and break it into separate image portions presented on different puzzle pieces and then the puzzle pieces are brought together to form a completed composite image. More particularly, this invention relates to picture puzzles involving weaving of separate elongate strips of puzzle pieces together from at least partially flexible elongate puzzle strip pieces.

BACKGROUND OF THE INVENTION

Jigsaw puzzles are well known in the prior art which break a composite image into a plurality of separate image portions presented upon separate puzzle pieces. With a jigsaw puzzle, tortuous pathways exist between adjacent puzzle pieces. A user of the puzzle enjoys aligning the unique cutting contours and the image details together to create the overall composite image from the separate image portions provided on each puzzle piece.

While jigsaw puzzles are enjoyable, there are limits to how such puzzles can be configured. The image can be varied to provide various different degrees of difficulty. Also, puzzles having pieces of different shapes and sizes can be provided and the contours of the cut lines between the adjacent puzzles pieces can be varied to provide a variety of different interesting contours and varying different degrees of interlocking of the adjacent puzzle pieces.

Many individuals enjoy the creative process associated with weaving various different elongate items together. Woven elements can include flexible generally cylindrical elongate objects such as threads or yarn, or more planar objects such as strips of fabric or paper of varying degrees of flexibility. Weaving can include planar work or three-dimensional work, with the woven elements typically separated into two groups.

What has heretofore been lacking is a puzzle which combines the desirable attributes of a jigsaw picture puzzle with the enjoyability and satisfaction which comes from weaving items together. Various complex problems are presented when combining picture puzzle and weaving methodologies into a common system. Accordingly, a need is presented to solve these problems so that a relatively high quality image can be produced when separate elements are woven together to complete a composite image from separate strips of woven puzzle pieces.

SUMMARY OF THE INVENTION

With this invention a puzzle is provided which includes separate strips of puzzle piece elements which each include portions of an overall composite image thereon. These separate strips can be woven together to form the composite image when properly oriented together. A weave puzzle is thus produced.

The weave puzzle is typically comprised of two sets of strips which can be referred to as first strips and second strips. In an exemplary embodiment depicted herein, the first strips are in the form of horizontal strips and the second strips are in the form of vertical strips. Each of the strips are preferably elongate in form extending between ends and having elongate sides defining a width of each strip. While the strips could have a variable shape such as a zig-zag or sinusoidal shape, most typically the sides are straight and parallel to each other.

To enhance complexity of the solving of the puzzle, in the embodiment disclosed herein portions of the image on each strip are hidden by a blank. This blank can be in the form of a white space or a plain dark space or some other form of printed material which does not form a portion of the image. These blanks define portions of each strip which weave under portions of other strips. Thus, the blanks are not visible once the weave puzzle is completed. Preferably, the blanks are limited to coverage of less than an entire amount of each strip which weaves under another strip, so that the edges of the blanks remain hidden completely when the weave puzzle is finished.

Other variations which can be provided for the puzzle and various different embodiments to enhance interest, to provide various different presentations and/or to enhance complexity could include changing shapes of the puzzle strips or changing shape of an overall shape of the puzzle into which the puzzle strips are oriented. For instance, the overall puzzle could be triangular in shape with the strips having varying different orientations relative to an outer triangular boundary of the puzzle. The puzzle could be circular in shape. The strips could be linear and perpendicular to each other or non-perpendicular to each other, or some of the strips could be circular with other strips extending radially or otherwise linearly relative to the circular strips which would be concentric to each other. The outer boundary of the puzzle could be polygonal with any of a number of different sides with the strips either oriented relative to certain flat sides of the polygon or not. The strips can be oriented relative to each other either perpendicular, or with an angle other than perpendicular, or can have some of the strips be curved and others straight such as with a radial and circumferential correlation between circular strips and linear strips. While typical strips have a constant width, the strips could have a tapering width, potentially even tapering to a point, such as at the center of a circular puzzle.

While the embodiment disclosed herein includes blanks alternating with image portions on each strip, the strips could be provided without blanks, but rather with complete image portions therealong. To enhance complexity, the blanks could be replaced with image portions from an image distinct from the image portions. In this way, each strip would contain portions of two different images thereon. Depending on which way the strips are woven together, one of two images would appear. This complexity can be further enhanced if both sides of the strips are provided with images. Thus, a puzzle could be provided which has one image for a front side and one image for a rear side and with or without blanks alternating with image portions on each strip. As a further alternative, a front side of the puzzle could have two images and a rear side of the puzzle could have two images so that a total of four images are provided, with portions of a first image alternating with portions of a second image on a first side, made of horizontal and vertical strips and with alternating portions of a third image and a fourth image provided on a reverse side of the horizontal and vertical strips. Thus, conceivably a puzzle could be provided which has multiple different correct solutions with different images appearing depending on how the puzzle is woven together.

To facilitate efficient manufacturing of the weave puzzle, in one method of such weave puzzle manufacture two sheets are printed for each puzzle including a horizontal strip sheet and a vertical strip sheet, or other first strip sheet and second strip sheet configurations. The horizontal strip sheet has at least a portion of the composite image printed thereon, as does the vertical strip sheet. The horizontal strip sheet is cut into separate strips by cutting along cut lines. Similarly, the vertical strip sheet is cut into vertical strips by cutting along cut lines.

When forming the strip sheets, gaps are formed in the image where portions of the image are removed. The cuts occur along the cut lines precisely where these gaps have been removed. Such gaps keep the portions of the image properly aligned together within the overall composite image once woven together, to account for the less than perfectly planar orientation of the strips when woven together and the resulting minor distortion that results if not counteracted by provision of such gaps. In an alternative embodiment, each cut is made in the form of a pair of adjacent cut lines with a small gap therebetween which is removed.

In a further embodiment, a "downloaded" weave puzzle manufacture application allows a user to include a custom image or other image. Software would convert the image into digital files of first and second strip sheets, such as vertical strip sheets and horizontal strip sheets. These two strip sheets could be printed by the user and then cut along cut lines to cut the strip sheets into individual strips. These strips can then be woven together to complete the puzzle. A resulting customized woven image would result.

In a further embodiment, the weave puzzle is programmed into a computer so that the strips of the puzzle appear as objects on a display which can be manipulated by a user to reorient the strips and complete the electronic weave puzzle by manipulating objects on the display of the computer.

OBJECTS OF THE INVENTION

Accordingly, a primary object of the present invention is to provide an entertaining puzzle involving weaving of elongate strips of material together which each include image portions which together form a composite image once woven together.

Another object of the present invention is to provide a method for forming strips which make up a weave puzzle of elements which can be woven together to present a composite image.

Another object of the present invention is to provide a method for adjusting for errors that occur in images when images are cut into separate strips and then woven together.

Another object of the present invention is to provide a method to personalize the images on the puzzle by inputting said images into a "downloaded" or purchased application that outputs first and second (horizontal or vertical) strip sheets to be printed, cut and assembled by the user.

Another object of the present invention is to provide a method for operating an electronic weave puzzle on a computer.

Other further objects and configurations of the present invention will become apparent from a careful reading of the included drawing figures, the claims and detailed description of the invention.

DESCRIPTION OF THE PREFERRED EMBODIMENT

Figure 1:
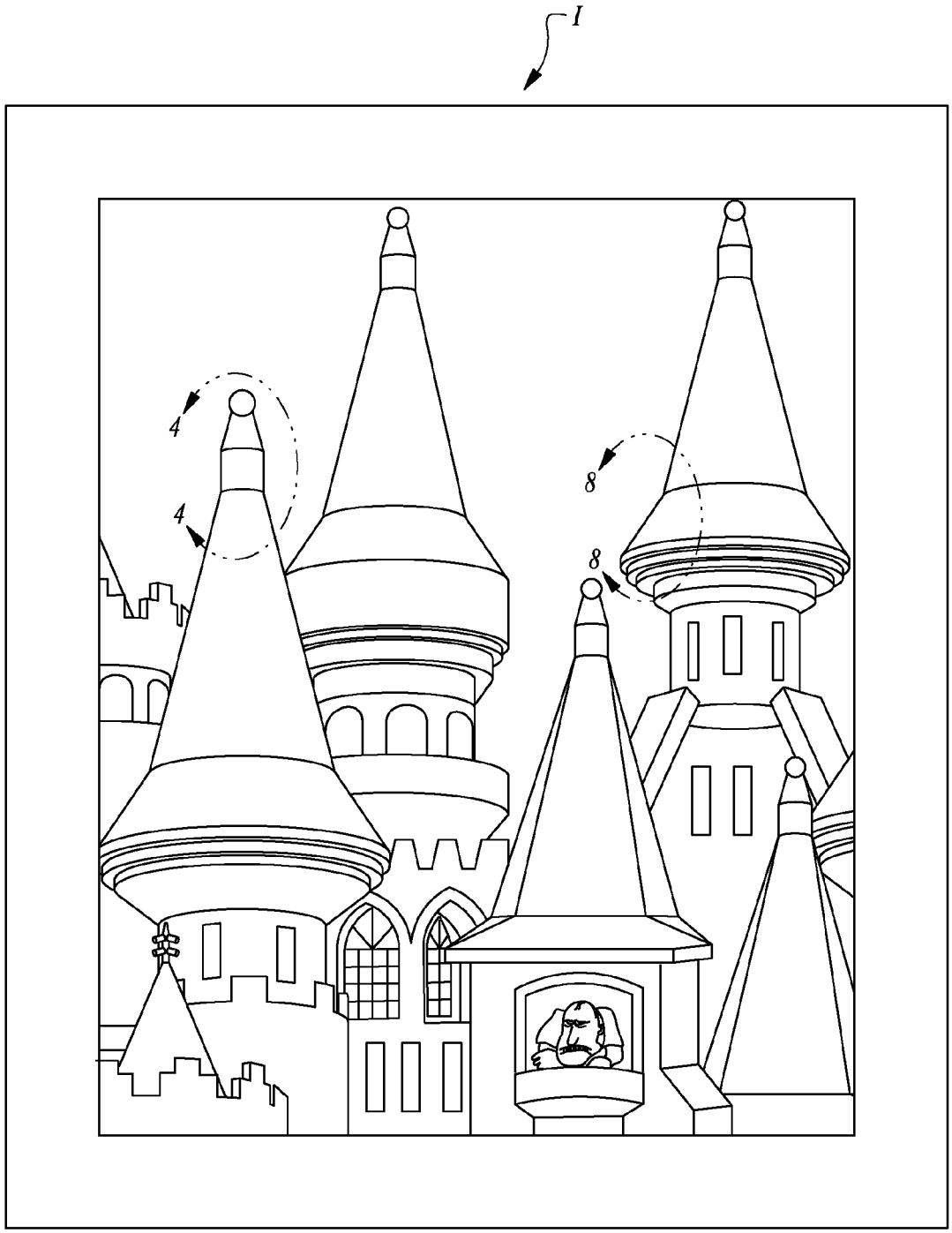
FIG. 1 is a top plan view of an image which is to be made the subject of a weave puzzle according to an embodiment of this invention.
Figure 2:
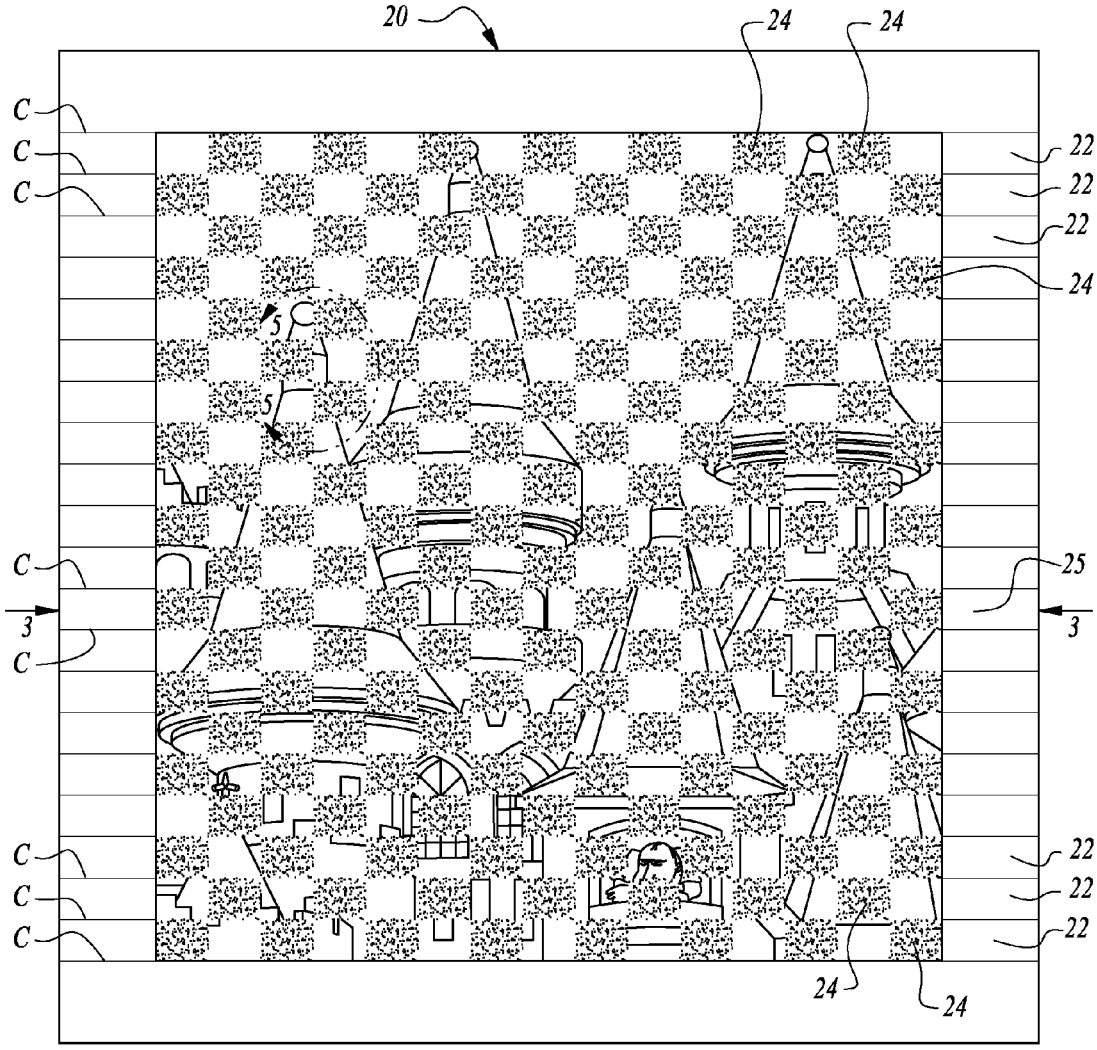
FIG. 2 is a top plan view of a horizontal strip sheet after it has been printed with an image and before cutting of the sheet into separate horizontal strips.

Referring to the drawings, wherein like reference numerals represent like parts throughout the various drawing figures, reference numeral 10 (FIGS. 10 and 11) is directed to a weave puzzle formed by the weaving together of separate strips such as horizontal strips 22 and vertical strips 32 together. In this embodiment, the strips are provided in the form of a plurality of horizontal strips 22 and a plurality of vertical strips 32 but the strips could have a variety of different configurations and orientations. Each strip 22, 32 includes an image portion 26, 36 (FIGS. 3 and 7) and optionally but preferably also blanks 24, 34 (FIGS. 5, 6, 9 and 10) which obscure portions of the composite image. An image is thus produced by weaving the strips 22, 32 together to form the overall weave puzzle 10.

Figure 10:
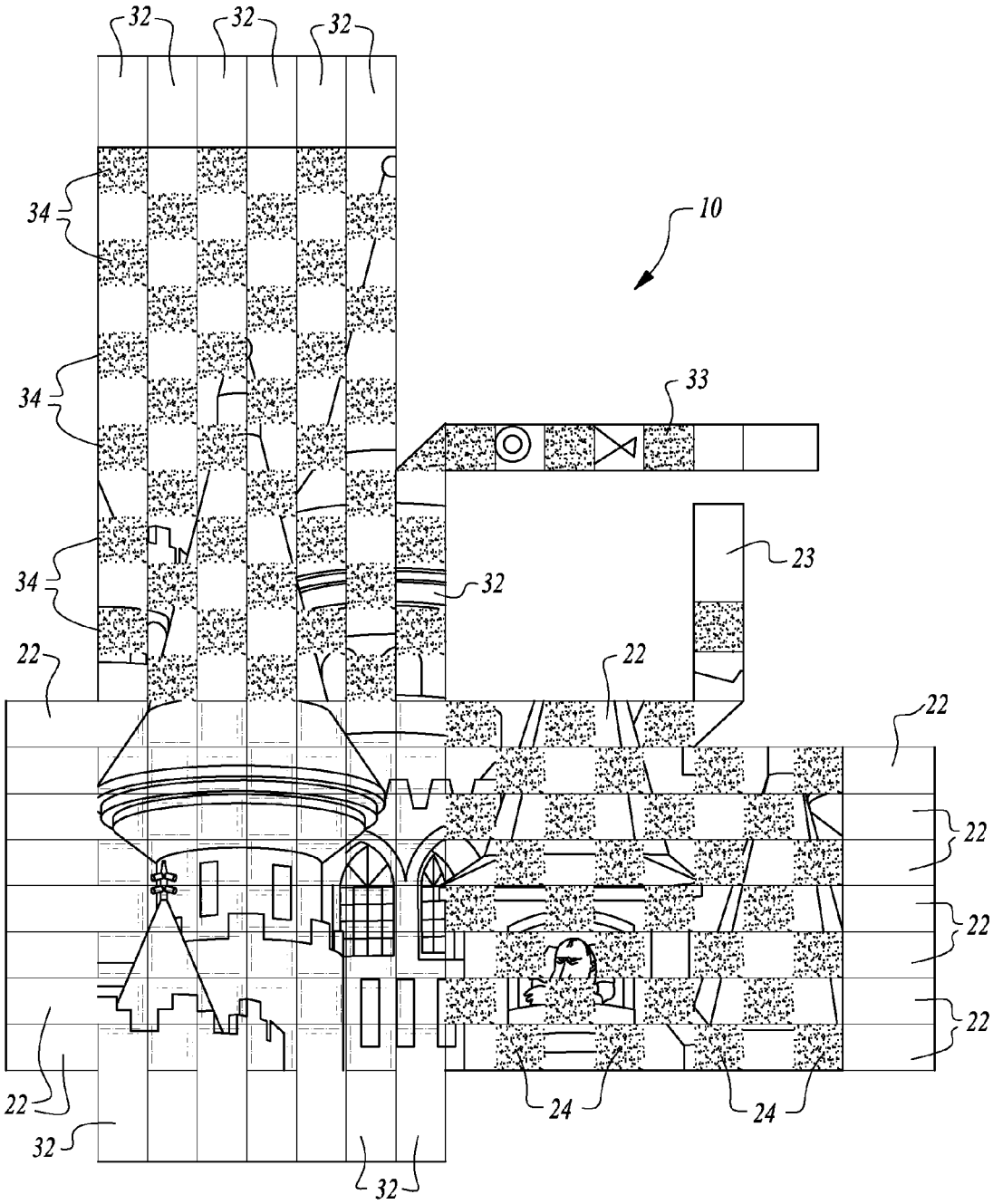
FIG. 10 is a top plan view of the weave puzzle of this invention when partially completed with horizontal strips and vertical strips woven together, and also depicting an option where a reverse side of the strips are also provided with printing thereon which can be in the form of a separate image.
Figure 11:
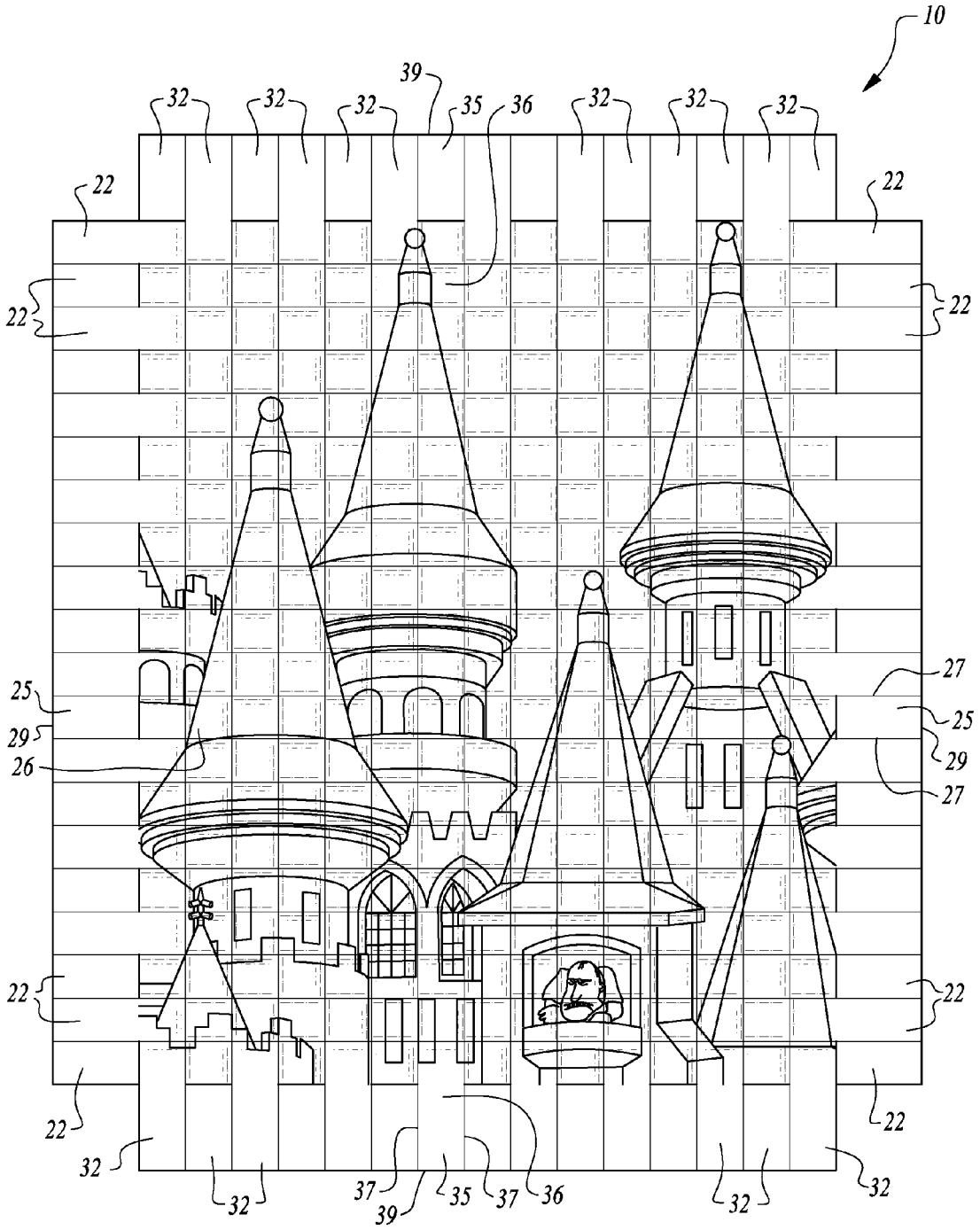
FIG. 11 is a top plan view of the weave puzzle after it has been completed by weaving each of the horizontal strips and each of the vertical strips together to complete the composite image similar to that depicted in FIG. 1.

In essence, and with particular reference to FIGS. 10 and 11, basic details of the weave puzzle 10 of this invention are described, according to this exemplary embodiment. The horizontal strips 22 are elongate in form and are configured to weave in and out with vertical strips 32. The vertical strips 32 have an elongate form and weave in and out with the horizontal strips 22. The alternating weave pattern results in alternating portions of the horizontal strips and vertical strips to be visible while covering portions of the other strip. The covered portions of each strip 22, 32 are preferably fitted with a blank 24, 34 to enhance a difficulty in identifying the strips 22, 32 and orienting them for weaving together.

More specifically, and with particular reference to FIGS. 2-5, details are provided for the horizontal strip sheet 20 from which the individual horizontal strips 22 are formed according to a preferred embodiment of this invention. Preferably, the individual horizontal strips 22 are initially provided together on a horizontal strip sheet 20. This strip sheet 20 can be printed paper or printed other flexible materials. Options include vinyl, cardboard, textiles and other flexible planar materials. This horizontal strip sheet 20 has a plurality of individual horizontal strips 22 thereon. Each horizontal strip has different portions of an overall image I (FIG. 1) displayed thereon. These image I portions are preferably provided upon the horizontal strip sheet 20 through printing. Other forms of placement of the image portions onto the horizontal strip sheet 20 could alternatively be provided, including embossing, etching and any other methods known in the prior art or hereafter invented which can place a visually discernible portion of an image onto a planar at least somewhat flexible thin sheet.

As depicted in FIG. 10, a reverse side 23 of the individual strips 22 can also be provided with a separate image thereon. To be able to see both the front and the rear images, the blanks 24 on the reverse side 23 are located in a pattern alternating with blanks 24 on the front side. In such an embodiment the entire horizontal strip sheet 20 has a reverse side which has printing thereon in the form of an image. This image on the reverse side 23 (FIG. 10) could be the same image I, or could be a distinct image and would also typically have a plurality of blanks. Once the weave puzzle is completed, it can be inverted and a separate image is seen on the reverse side. To enhance difficulty of the puzzle, the image associated with the reverse side can be similar to, but not identical to, the image on the front side, to cause the user to exercise greater care when deciding which side of each strip should be placed facing upward.

The individual horizontal strips 22 are depicted having a constant width and with parallel sides for each horizontal strip 22. However, in alternative embodiments the strips 22 could have varying widths and their sides could be formed with a contour other than straight. For instance, the cut lines C could have a zig-zag or sinusoidal pattern or an irregular pattern and still be capable of weaving to some extent.

Figure 3:
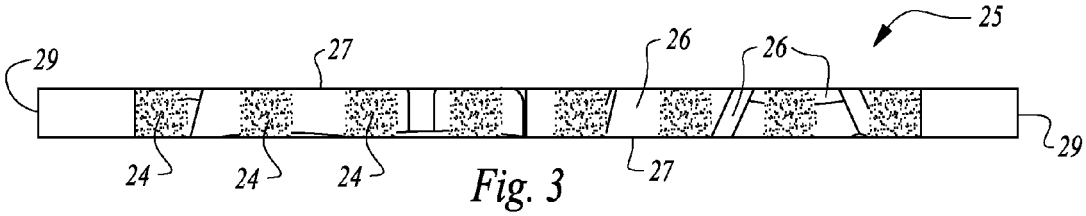
FIG. 3 is a top plan view of a single exemplary horizontal strip after it has been cut from the horizontal strip sheet of FIG. 2.

FIG. 3 depicts an individual exemplary horizontal strip 25 separated from the horizontal strip sheet 20, such as by cutting along cut lines C adjacent to the exemplary horizontal strip 25. This exemplary horizontal strip 25 includes image portions 26 alternating with blanks 24. Elongate sides 27 extend between ends 29 to form a perimeter of this exemplary horizontal strip 25. The other strips 22 are of similar size and shape in this embodiment of the invention, but with different image portions 26 thereon. Also, the individual horizontal strips 22 have an alternating pattern for the blanks 24. The blanks are not strictly required, but can add some difficulty to the solving of the puzzle by causing portions of the image to be obscured. The blanks 24 are positioned where the horizontal strips 22 weave under vertical strips 32 so that the blanks 24 are not seen once the strips 22, 32 are woven together.

Figure 5:
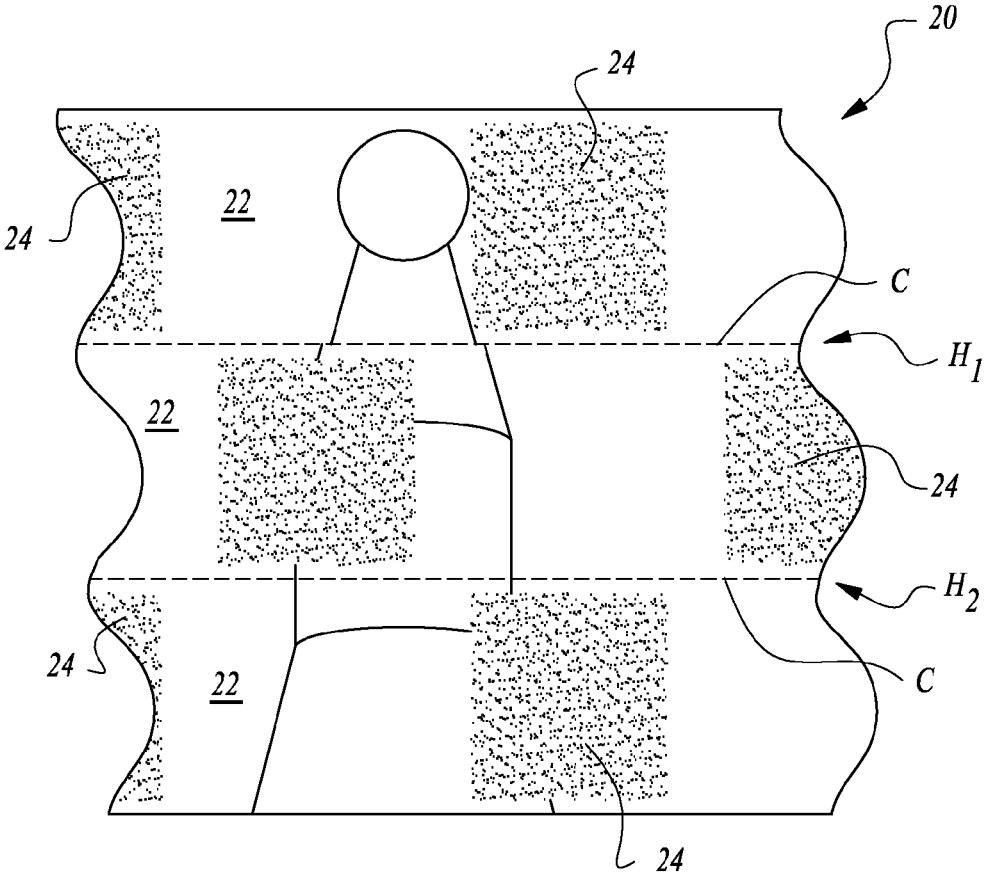
FIG. 5 is a detail of a portion of that which is shown in FIG. 2 taken along lines 5-5 of FIG. 2 and depicting how the image on the horizontal strip sheet appears at the horizontal gap removal sites aligned with cut lines thereof, and with the cut lines depicted in broken lines.
Figure 6:
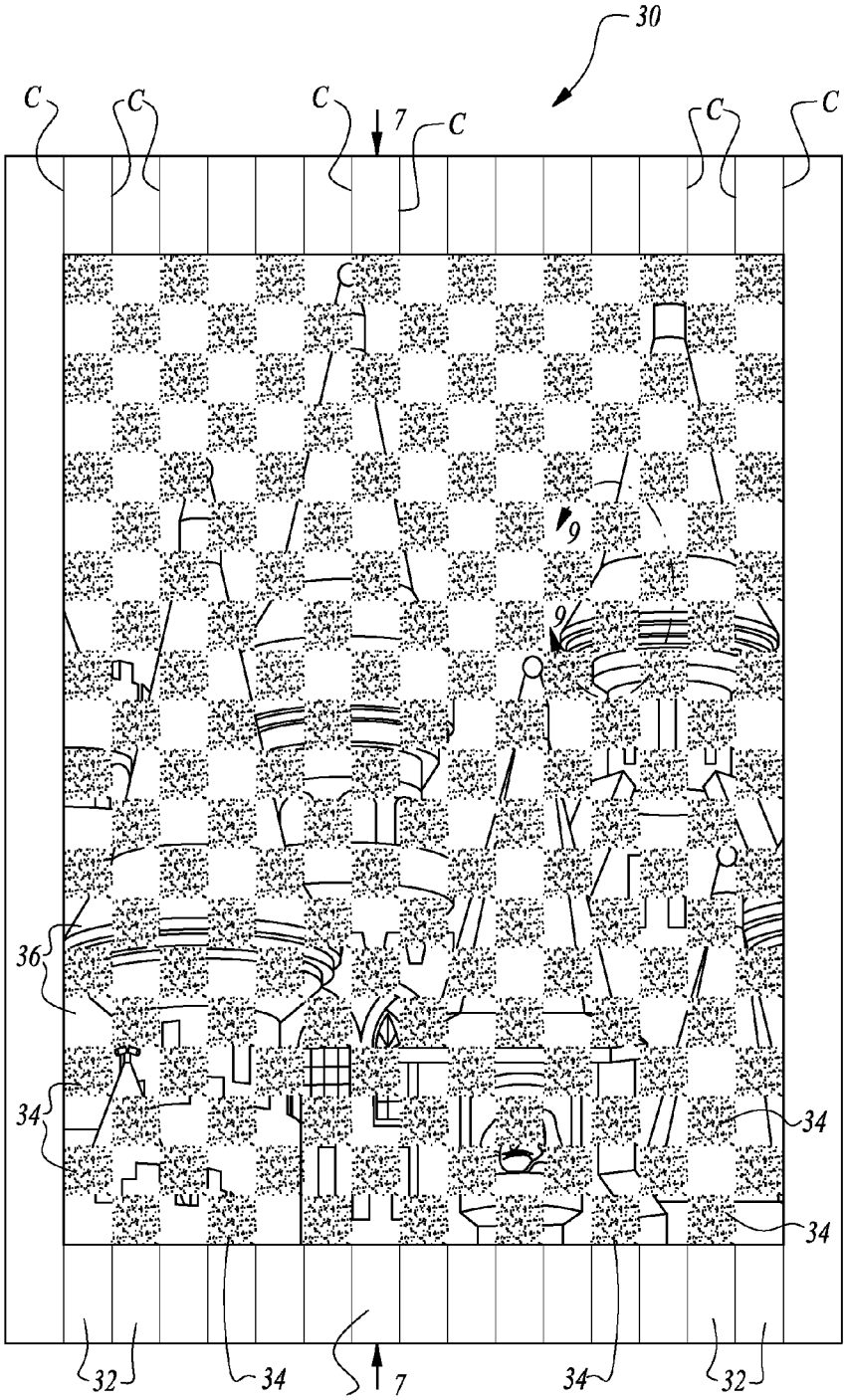
FIG. 6 is a top plan view of a vertical strip sheet after it has been printed with an image and before cutting of the sheet into separate vertical strips.

As particularly depicted in FIG. 5, the blanks 24 do not extend over fifty percent of the surface of the horizontal strip sheet 20. Rather, the blanks have a size which is slightly reduced to less than fifty percent coverage of the overall horizontal strip sheet 20. In particular, each blank preferably is spaced slightly away from the cut lines C. Such spacing away from the cut lines is advantageous to prevent small portions of the blanks 24 from becoming visible in the completed weave, and to give some margin for the positioning of the cut lines C without having the cut lines C cut into the blanks 24.

The width of each blank 24 is shortened so that a width of each blank along a long dimension of the strip 22 is less than a width of a space between each blank on each strip 22. As a strip 22 weaves over and under vertical strips 32, a slightly greater amount of each strip 22 is revealed when weaving over the vertical strip 32, than when weaving under. By limiting dimensions of the blanks 24 in this manner, the blanks 24 remain hidden when the weave puzzle 10 is completed.

In one embodiment the distance between the horizontal edges of the blanks 24 and the cut lines C is for example 2/32 of an inch and the vertical edges of the blanks 24 are brought together to narrow a width of each blank 24 by 4/32 of an inch at each edge thereof, beyond a width for the blanks which would be provided if the blanks 24 instead had a cumulative horizontal width accounting for half of a total horizontal length of the overall horizontal strip 22. Such measurements are suitable when the blanks 24 have a horizontal width of 0.85 inch and a vertical height of 0.75 inch and for horizontal strips 22 which have a one inch height between cut lines C. The horizontal narrowing of the blanks 24 makes the overall weave puzzle 10 more forgiving of minor weave errors and still keeping the blanks 24 hidden when the weave puzzle 10 is complete. The vertical distance between the horizontal edges of the blanks 24 and the cut lines C makes the overall weave puzzle 10 more forgiving of small registration errors between the cut lines C and cutting equipment cutting the sheet 20 into the horizontal strips 22. Similar blank dimensions are typically also provided for blanks 34 on the vertical strips 32. The dimensions of the blanks 24, 34 can be adjusted up or down to accommodate different material thicknesses and to otherwise satisfy the particular preferences of the manufacturer.

Figure 4:
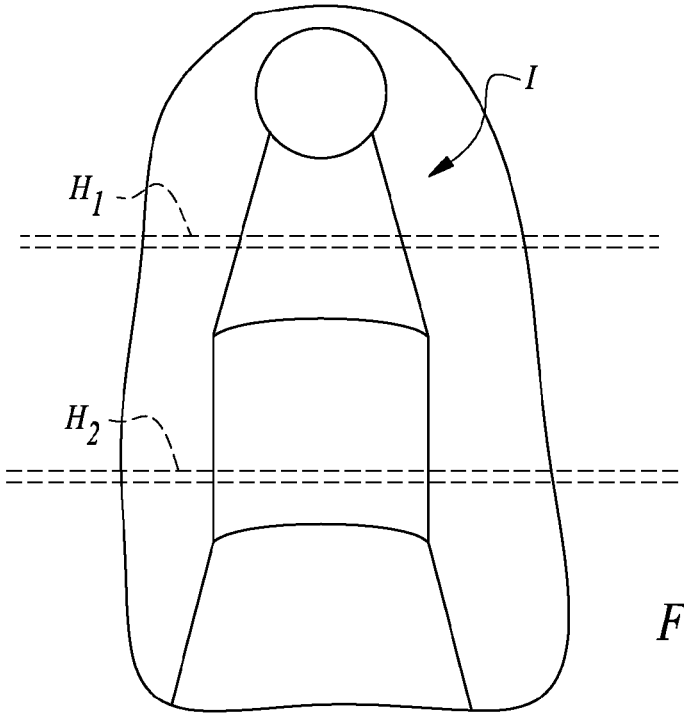
FIG. 4 is a top plan view of a portion of that which is shown in FIG. 1 taken along lines 4-4 of FIG. 1 and illustrating where horizontal gaps are formed by removing sections in the image to produce horizontal strips which are suitable for weaving with vertical strips to form a properly displayed composite image, such as that depicted in FIG. 11.

Importantly, according to the embodiment depicted herein, the horizontal strip sheet 20 has the image I associated therewith in the form of separate image portions 26 (FIG. 3) altered slightly. Such alteration results in the removal of gaps along cut lines C. As depicted in FIG. 4, the image I is first caused to have horizontal removed portions H identified. In the portion of FIG. 1 depicted in FIG. 4, two such horizontal removed portions H are shown, including horizontal removed portion $H_1$ and horizontal removed portion $H_2$. Through utilization of image processing software, this gap results in having a small strip of the image removed between the two lines bounding the horizontal removed portions $H_1$, $H_2$, etc. Portions of the image I above and below these removed portions are then brought together.

A somewhat disjointed final image is thus printed onto or otherwise placed upon the horizontal strip sheet 20 (FIG. 5). Careful study of FIG. 5 shows that the horizontal removed portions $H_1$ and $H_2$ are now depicted by single dashed lines which correspond with the cut lines C, rather than a pair of dashed lines. Also, portions of the image can be seen to "jog" at the cut lines C because portions of the image I have been removed. The horizontal strip sheet 20 is cut along the cut lines C, and after such cutting, this "jog" in the image can no longer be seen. When the strips 22 are woven together with vertical strips 32, the small spacing required between the strips 22 to accommodate passage of the vertical strips 32 therebetween in a weaving pathway, causes the image I to be restored and to complete an overall accurate image for the weave puzzle 10 (FIGS. 10 and 11). When dimensions such as those identified above for the blanks 22 are provided, and when the strips 22 are formed of a thin paper-like material, a gap of 2/32 is considered proper for thin materials, but can vary.

In an alternative embodiment, rather than identifying the horizontal removed portions H and removing them from the image that is placed upon the horizontal strip sheet 20, the horizontal strip sheet 20 can be provided with an image I precisely the same as the image I depicted in FIG. 1 then, rather than cutting along singular cut lines C, double cuts along two cut lines adjacent to each other but spaced apart by a small amount can be utilized. This spacing would be similar to the spacing between the boundaries of the horizontal removed portions $H_1$ and $H_2$ of FIG. 4. With such a double cutting procedure, a small strip of the sheet 20 would be discarded between each strip 22.

With particular reference to FIGS. 6-9, corresponding details of the vertical strip sheet 30 for forming individual vertical strips 32 is described, according to this exemplary embodiment. To simplify this description, it is initially noted that the vertical strip sheet 30 is analogous in many ways to the horizontal strip sheet 20 of FIGS. 2-5. Thus, the horizontal strip sheet 30 provides a plurality of individual vertical strips 32 which include blanks 34 obscuring portions of an image depicted thereon. An optional reverse side 33 can be provided (FIG. 10) if desired. Similar to the reverse image on horizontal sheet 20 the blanks 34 are alternated to allow viewing.

Figure 7:
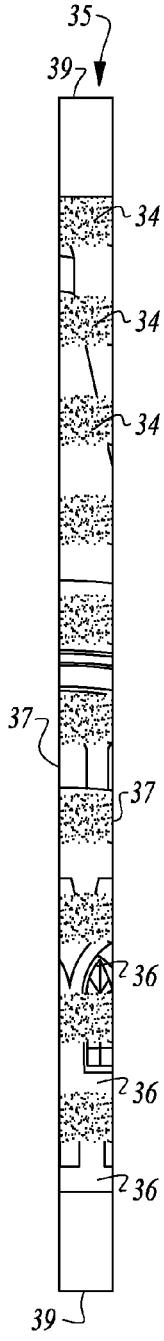
FIG. 7 is a top plan view of a single exemplary vertical strip after it has been cut from the vertical strip sheet of FIG. 6.

An exemplary vertical strip 35 is depicted in FIG. 7. This exemplary vertical strip 35, as well as the other vertical strips 32 include image portions 36 spaced apart by blanks 34. Elongate sides 37 extend between ends 39 which in this embodiment are parallel to each other and configure the sides to have a straight contour.

Figure 8:
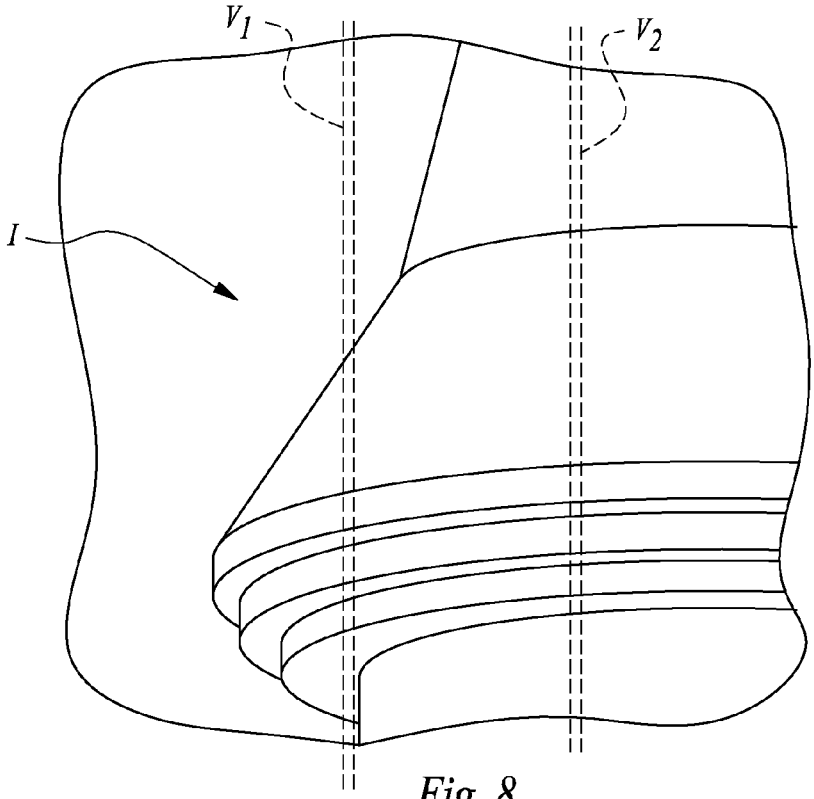
FIG. 8 is a top plan view of a portion of that which is shown in FIG. 1 taken along lines 8-8 of FIG. 1 and illustrating where vertical gaps are formed in the image to produce vertical strips which are suitable for weaving with horizontal strips to form a properly displayed composite image, such as that depicted in FIG. 11.
Figure 9:
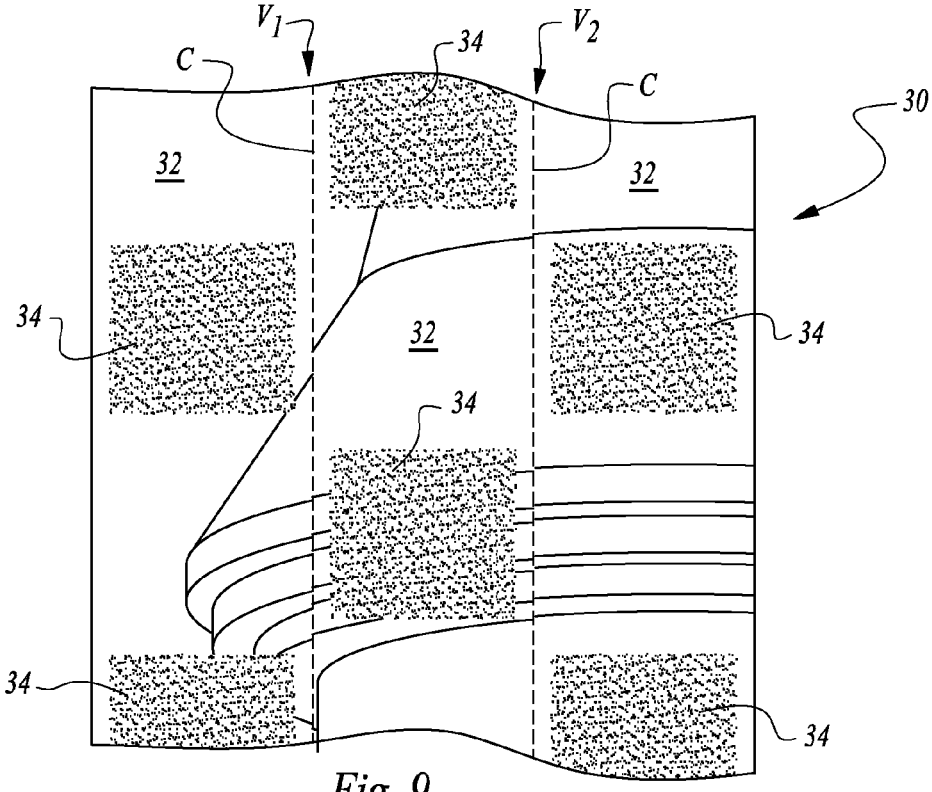
FIG. 9 is a detail of a portion of that which is shown in FIG. 6 taken along lines 9-9 of FIG. 6 and depicting how the image on the vertical strip sheet appears at the vertical gap removal sites aligned with cut lines thereof, and with the cut lines depicted in broken lines.

Cut lines C extend vertically in the vertical strip sheet 30 to separate the vertical strip sheet 30 into separate individual vertical strips 32. As with the horizontal strip sheet 20, the blanks 34 are sized and shaped smaller than half of the overall surface of the vertical strip sheet 30. The image printed upon the vertical strip sheet 30 is modified relative to the image I of FIG. 1, in that vertical removed portions V are taken out along the cut lines C. In FIG. 8 such vertical removed portions $V_1$ and $V_2$ are depicted in FIG. 8 as having some width, but in FIG. 9 as being at lines of no width. Portions of the image have been removed such that a disjointed appearance is provided for portions of the image. However, after cutting, the vertical strip sheet 30 along the cut lines C, such disjointedness is no longer seen. When the vertical strips 32 are woven together with the horizontal strips 22, a completed image I without distortion is provided (FIGS. 10 and 11). As with the horizontal strip sheet 20, an alternative to such vertical removed portions V involves utilizing double cut lines and discarding a thin cut portion between the two cut lines.

In use and operation, a user would array the various different strips 22, 32, such as upon a flat surface and study the image portions thereof. If the overall puzzle 10 is square, all of the strips 22, 32 would be of similar length. Through a study of the image portions, one might separate the strips 22, 32 into what are believed to be vertical strips 32 and what are believed to be horizontal strips 22. As an alternative, some distinctive portion of the image can be identified and vertical and horizontal strips which include that image portion can be located. They can then be woven together in a way which causes the image I to be properly displayed. Further strips 22, 32 can be added to the weave by aligning the image portions of separate pieces to produce the final composite image and complete the overall weave of the puzzle 10.

In one alternative embodiment of this invention, a user first supplies an image to a manufacturer. The manufacturer prints appropriate horizontal strip sheets 20 and vertical strip sheets 30 and then cuts these sheets 20, 30 into individual strips 22, 32 (or the double cut methods used). The individual strips 22, 32 are then shipped to the user, or to an intended recipient of the user. This user or other intended recipient then has the enjoyable process of weaving the separate strips together to produce the image that was originally sent to the manufacturer. In one embodiment, such images might be photographs of individuals. The result is a portrait that has attributes of a photograph and attributes of hand crafted artwork.

This alternative embodiment where a user supplies a customized image to the manufacturer can be implemented without requiring the actions of a third party manufacturer. For instance, computer software, such as in one embodiment a computer application running on a computer or potentially on a smartphone or other computing device, is programmed to create the first strip sheet and second strip sheet from an image that is initially provided. In particular, a user would first select an image which is to be made into the weave puzzle. Second, the user could elect parameters such as the desired shape of the puzzle, desired dimensions of the puzzle, desired orientation of the strips of the puzzle, and any other details, such as those described above.

Figure 12:
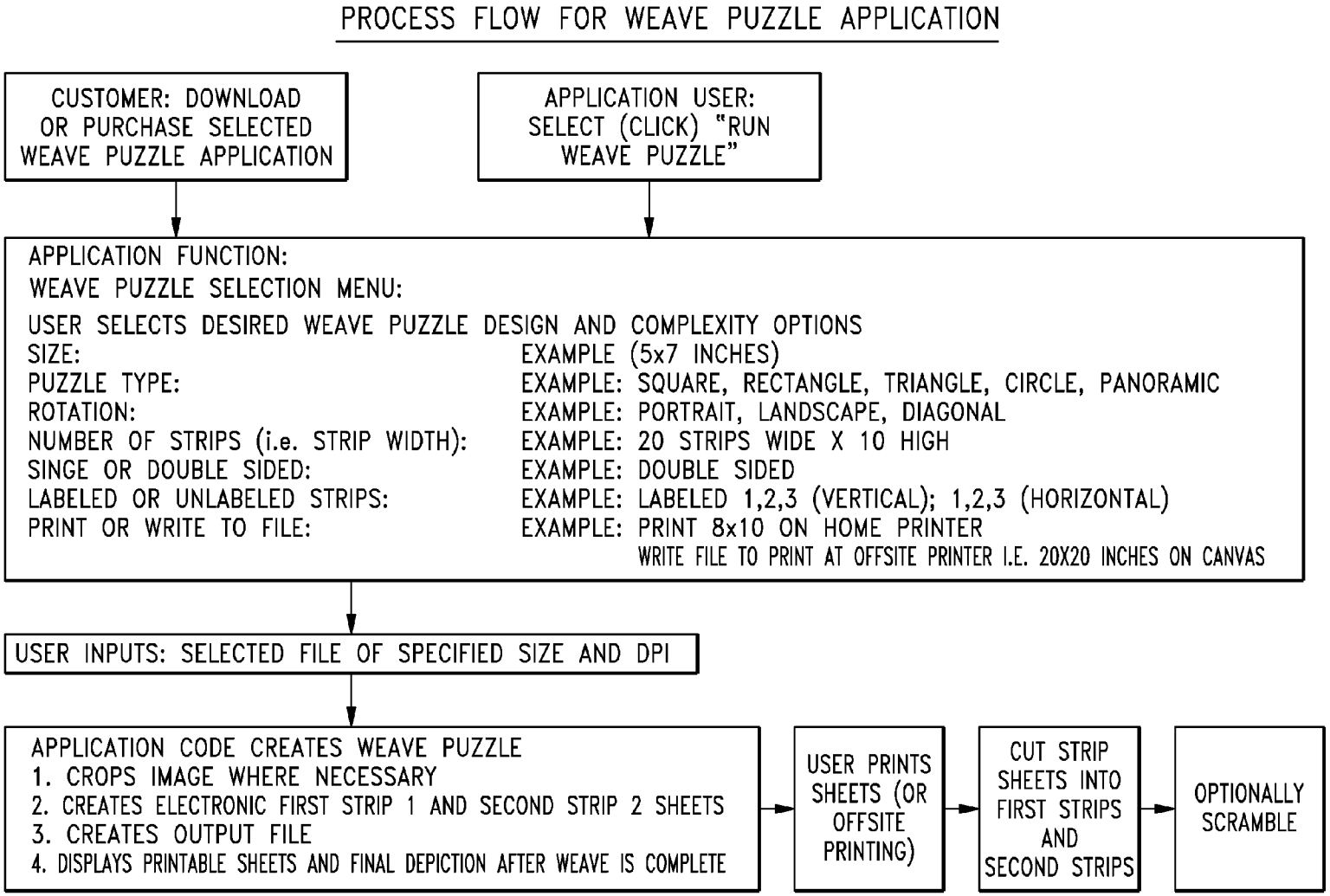
FIG. 12 is a flow chart defining a series of steps in a downloadable customizable computer application implemented weave puzzle.

The application is programmed to take the initial image and separate it into a first strip sheet and a second strip sheet generally depicting electronic forms corresponding with the horizontal strip sheet 20 and vertical strip sheet 30 if a rectangular puzzle with perpendicular strips is to be chosen. The software acts upon the two strip sheets to appropriately cut out portions of the image as described in detail above. If desired, a cut line can also be printed onto the strip sheets which is visible to a user. Finally, the user prints the strip sheets and after they have been printed cuts the strip sheets into individual strips. The individual strips are then ready to be woven together to result in a completed image having the customized final image desired, and without requiring any third party manufacturing. Details of this embodiment are illustrated in FIG. 12.

Figure 13:
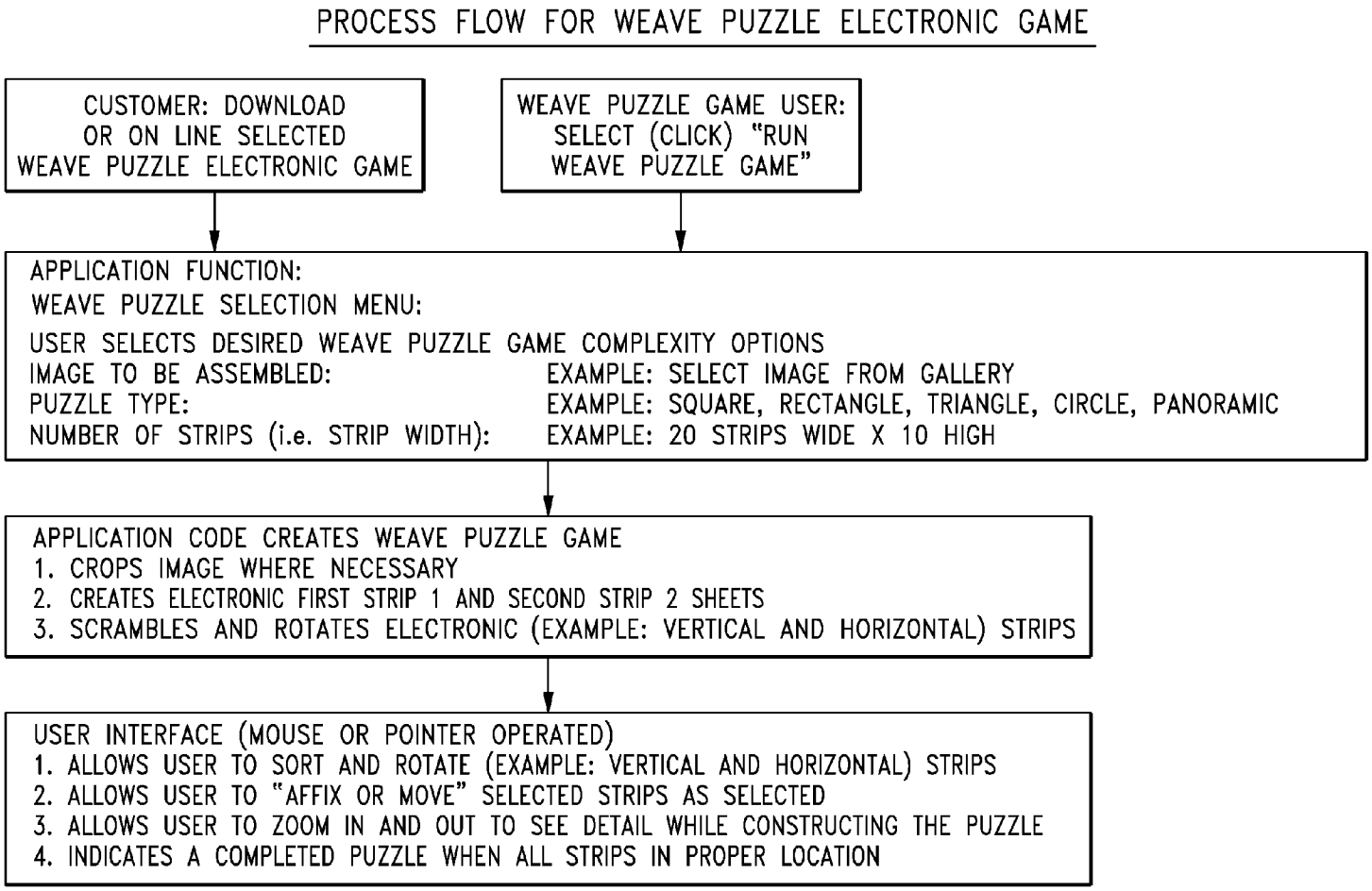
FIG. 13 is a flow chart defining a series of steps in a software application running on a computer or other electronic appliance which implements a weave puzzle activity on a display.

In another embodiment, the weave puzzle is executed on a computer (FIG. 13). The computer includes a memory, and typically a power supply as well as a display. Some object manipulation interface is provided which allows for objects displayed on the display to be manipulated by a user. Such an object manipulation interface could be a touchscreen of the display itself or could be a cursor control device such as a mouse, or cursor keys and/or other keys on a keyboard or other input device. Other forms of object manipulation interfaces could also be utilized.

These strips appear as objects displayed upon the display through operation of computer software code running on a central processing unit or other processor of the computer. The computer could be any of a variety of different computers including personal computers or other computing devices such as in the form of an application running upon a smart phone having a suitable display thereon, or a gaming console. In one embodiment the display is associated directly with and built into a common enclosure with the central processing unit of the computer, while in other embodiments a separate display is provided, such as a television set.

In the computer implemented variation of this invention the objects are initially presented in a disorganized array. This disorganized array could include horizontal and vertically oriented strips or strips that are oriented in random different ways. The object manipulation interface can be utilized to rotate the various different strips to cause them to be oriented either horizontally or vertically. In weaves that have orientations for the strips other than horizontal and vertical, rotation can occur to align with whatever weave is intended. In one embodiment the objects can be touched virtually through use of the object manipulation interface and then dragged to a new desired location. The strips can be rotated (flipped over in one embodiment) and woven together. One form of such weaving can occur by touching various different portions of each strip object which overlap another strip object to toggle between strip portions being on top of or beneath other strip objects. In one embodiment when a strip is properly located it becomes frozen in place precisely where required to complete the image to avoid the frustration associated with strips that had previously been properly positioned becoming improperly positioned. For instance, the strips might snap into particular locations (either correct or incorrect) rather than having an infinite number of possible positions.

While the exemplary embodiment shows a weave having horizontal and vertical strips 22, 32, it is conceivable that the strips might be oriented non-perpendicular to each other, such as with some of the strips extending horizontally and the other strips extending diagonally, such as at an angle 60° away from the horizontal strips. With such a weave, the blanks would have a rhomboid shape and the image portions would also be altered into a parallelogram-type partial depiction of the composite image.

In another embodiment the weave could include concentric circles in a first set of strips and radiating strips that radiate from a center as a second set of strips. Such radiating strips might be somewhat pie-shaped and radiate from a center point or might be somewhat pie-shaped but extend entirely across and through a center with a narrow central portion passing through the center.

Various different weave patterns other than a standard over-under-over-under type weave pattern could also be utilized with any weave pattern known in the prior art potentially used according to this invention (e.g. over-over-under-under), and also other weave patterns which might be developed in the future.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. A weave puzzle comprising in combination:

a plurality of first strips;

each said first strip having different portions of an image thereon;

a plurality of second strips;

each said second strip having different portions of the image thereon;

said portions of said image on said plurality of first strips and said plurality of second strips uniting to form a composite image when said plurality of said first strips and said plurality of said second strips are woven together; and wherein image portions of said first strips have gaps thereon, said gaps located between adjacent said first strips such that when adjacent said first strips are laid adjacent each other, gaps in said composite image exist between said first strips, said gaps creating a disjointed composite image across the adjacent first strips.

2. The puzzle of claim 1 wherein said first strips extend in a first direction relative to said image and said second strips extend in a direction substantially perpendicular to said first direction.

3. The puzzle of claim 1 wherein said strips have substantially parallel straight sides extending between ends thereof.

4. The puzzle of claim 1 wherein at least one of said strips includes a plurality of blanks thereon, said blanks defining portions of said strips where no portion of said image is displayed.

5. The puzzle of claim 4 wherein each of said first strips and each of said second strips includes a plurality of said blanks thereon, said blanks provided in an alternating pattern with portions of said first strips which are woven under portions of said second strips and portions of said second strips which are woven under portions of said first strips having said blanks thereon.

6. The puzzle of claim 5 wherein said blanks cover less than a full width of said strips with said blanks spaced inboard of elongate sides of said strips.

7. The puzzle of claim 6 wherein said blanks cover less than fifty percent of each said strip and said blank portions cover less than all of portions of said strips overlaid by other said strips.

8. The puzzle of claim 1 wherein a width of said gap between adjacent said first strips is at least partially a function of material thickness of said first strips.

9. The puzzle of claim 1 wherein said plurality of first strips are configured to include image portions on both opposing surfaces of said first strips.

10. A weave puzzle comprising in combination:

a plurality of first strips;

each said first strip having different portions of an image thereon;

a plurality of second strips;

each said second strip having different portions of the image thereon; said portions of said image on said plurality of first strips and said plurality of second strips uniting to form a composite image when said plurality of said first strips and said plurality of said second strips are woven together;

wherein each said first strip includes a pair of elongate sides on opposite sides of each said strip; and wherein when adjacent said first strips are placed with said elongate sides thereof against each other, a gap exists in said composite image between said strips, said gaps creating a disjointed composite image across the adjacent first strips.

11. The puzzle of claim 10 wherein each said second strip includes a pair of elongate sides on opposite sides of said second strips; and wherein when adjacent second strips are placed with said elongate sides thereof against each other, a gap exists in said image between said second strips.

12. The puzzle of claim 11 wherein when said first strips and said second strips are woven together, said gap in said image appears to at least partially go away due to at least slight angling of said first strips and said second strips as they are woven together.

13. The puzzle of claim 10 wherein at least one of said strips includes a plurality of blanks thereon, said blanks defining portions of said strips where no portion of said image is displayed.

14. The puzzle of claim 13 wherein each of said first strips and each of said second strips includes a plurality of said blanks thereon, said blanks provided in an alternating pattern with portions of said first strips which are woven under portions of said second strips and portions of said second strips which are woven under portions of said first strips having said blanks thereon.

15. The puzzle of claim 14 wherein said blanks cover less than a full width of said strips with said blanks spaced inboard of elongate sides of said strips.

16. The puzzle of claim 15 wherein said blanks cover less than fifty percent of each said strip and said blank portions cover less than all of portions of said strips overlaid by other said strips.

17. A woven image, comprising in combination:

a plurality of first strips;

each said first strip having different portions of the image thereon;

a plurality of second strips;

each said second strip having different portions of the image thereon;

said first strips and said second strips woven together to present a composite image made up of portions of said image on separate said first strips and said second strips; and wherein when adjacent first strips are placed with sides thereof against each other, a gap exists in said composite image between said strips, said gaps creating a disjointed composite image across the adjacent first strips.

18. The image of claim 17 wherein said gap is not apparent after said first strips and said second strips are woven together to present said composite image.

19. The image of claim 17 wherein a width of said gap between adjacent said first strips is at least partially a function of material thickness of said first strips.

20. The image of claim 17 wherein said first strips extend in a first direction relative to said image and said second strips extend in a direction substantially perpendicular to said first direction.

21. The image of claim 17 wherein said strips have substantially parallel straight sides extending between ends thereof.

22. The image of claim 17 wherein at least one of said strips includes a plurality of blanks thereon, said blanks defining portions of said strips where no portion of said image is displayed.

23. The image of claim 22 wherein each of said first strips and each of said second strips includes a plurality of said blanks thereon, said blanks provided in an alternating pattern with portions of said first strips which are woven under portions of said second strips and portions of said second strips which are woven under portions of said first strips having said blanks thereon.

24. The image of claim 23 wherein said blanks cover less than a full width of said strips with said blanks spaced inboard of elongate sides of said strips.

25. The image of claim 24 wherein said blanks cover less than fifty percent of each said strip and said blank portions cover less than all of portions of said strips overlaid by other said strips.

* * * * *